United States Patent [19]

Hedlund

[11] Patent Number: 4,458,382

[45] Date of Patent: Jul. 10, 1984

[54] DEVICE FOR CARDING, CLEANING OR OPENING OF FIBRE TUFTS

[76] Inventor: Karl O. F. Hedlund, Puuvillatehtaankatu 4B, 33210 Tampere 21, Finland

[21] Appl. No.: 427,704

[22] Filed: Sep. 29, 1982

Related U.S. Application Data

[63] Continuation-in-part of Ser. No. 172,065, Jul. 24, 1980, abandoned.

[51] Int. Cl.[3] ..... D01G 15/04

[52] U.S. Cl. ..... 19/100; 19/106 R

[58] Field of Search ..... 19/100, 101, 97, 98, 19/105, 106 R, 112, 200, 203, 204

[56] References Cited

U.S. PATENT DOCUMENTS

| | | | |
|---|---|---|---|
| 1,121,362 | 12/1914 | Holden | 19/106 R |
| 1,648,050 | 11/1927 | Keulin et al. | 19/106 R |
| 1,717,189 | 6/1929 | Clarisse | 19/100 |
| 2,964,801 | 12/1960 | Riehl et al. | 19/100 X |
| 3,066,358 | 12/1962 | Schiess | 19/106 R |
| 3,066,359 | 12/1962 | Kalwaites | 19/106 R |
| 4,011,631 | 3/1977 | Estebanell | 19/100 |

*Primary Examiner*—Louis Rimrodt

*Attorney, Agent, or Firm*—McAulay, Fields, Fisher, Goldstein & Nissen

[57] ABSTRACT

In a device for carding, cleaning or opening fibre tufts. An improvement comprises two or more rotating working members or organs (1, 2, 3) which have intersecting planes of rotation and they are arranged to make the fibres fed in at one end move in addition in an axial direction and pass through the lines of close proximity repeatedly in several changed planes of rotation, so that the fibres are worked by a high proportion of the working points before being doffed at the other end or "out" feed. In relation to the dimensions of the working members or organs, the fibres can dwell on the average a longer time in the device so modified and come into contact with a greater proportion of the wire points or pins in the system. This provides for and makes adequate processing of the fibres possible particularly with smaller units in comparison with conventional systems.

8 Claims, 6 Drawing Figures

DEVICE FOR CARDING, CLEANING OR OPENING OF FIBRE TUFTS

CROSS-REFERENCE TO COPENDING APPLICATION

This application is a Continuation-in-Part application of my copending application Ser. No. 172,065 filed Jul. 24, 1980 and abandoned.

BACKGROUND OF THE INVENTION

This invention relates to improvements in a device for carding, cleaning or opening fibre tufts.

When fibres are carded, cleaned or opened on most of hitherto used machines, they pass through the working organs at random, on an average low number of times. The single fibre is mostly moving in one and the same plane of rotation between the feeding and the doffing point. Opening and blending and a certain evening out of the fibre mass are achieved by using relatively wide working surfaces.

DESCRIPTION OF THE PRIOR ART

The prior art to which this invention relates is aware, inter alia, of the following U.S. Pat. Nos. 1,121,362; 1,717,189; 2,964,801; 1,648,052; 3,066,358; 3,066,359; and 4,011,631. These patents are concerned with methods for handling carded web after the carding proper has taken place on conventional carding machines. The carded web is either formed to a sliver to be coiled for later drafting (U.S. Pat. Nos. 1,121,362 and 1,648,050) or laid open for later condensing to a nonwoven fabric (U.S. Pat. Nos. 3,066,358 and 3,066,359). The methods for sliver or fabric forming are many and always comprise some transportation of the fibre web whether in a crosswise or axial direction. However, the elements whose planes of rotation intersect with those of the carding elements proper, i.e., the conveyor belt and delivery rollers in U.S. Pat. No. 1,121,362, the delivery rollers in U.S. Pat. No. 1,648,050 and the doffing devices in U.S. Pat. Nos. 3,066,358 and 3,066,359 are not aimed to, nor are they suitable for, feeding or returning the fibres back to be repeatedly worked by the carding elements.

With respect to the conventional, hitherto used systems for carding, cleaning, or opening of fibre tufts - and also for those used in the cited patents - a main characteristic is that the fibres pass through the lines of close proximity with the working elements basically in their own single plane of rotation from the feed "in" to the feed "out" or doffing point. Therefore, the fibres come into contact with a relatively low proportion of the wire points or pins in the system.

SUMMARY OF THE INVENTION

The invention provides in a device of the character described means whereby the fibres which are to be carded, cleaned or opened are forced to pass through the lines of close proximity repeatedly in several changed planes of rotation on their way from the feed in point at one end to the doffing point at the other end in axial direction, through an arrangement of the working organs which comprise intersecting planes of rotation.

The inventive concept thus consists in using intersecting planes of rotation to make the fibres move also in the axial direction for the most effective use of the pins or teeth of the working surfaces of a device for carding, cleaning or opening of fibre tufts.

BRIEF DESCRIPTION OF THE DRAWINGS

For a fuller understanding of the invention, reference is to be had to the following description in connection with the accompanying drawings wherein.

DESCRIPTION OF THE PREFERRED EMBODIMENTS

The invention makes it possible to achieve on an average a higher amount of fibre passages and thus better opening, blending and evening out of the fibre mass even when using a low number of relatively small sized working organs.

It is essential that the planes of rotation of at least two working organs are made to intersect, whereby it is possible to combine organs, which arranged with suitable chosen working faces, settings, direction and speed of rotation make the fibres worked change planes of rotation and also move in the axial direction of the working organs. The feed of the fibres can be mechanical or pneumatic at one end and final doffing at the other end in front of the shafts of the working organs.

Figure 1:
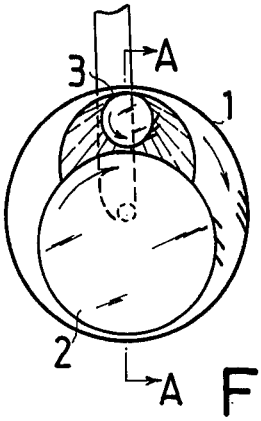
FIG. 1 is a sectional view showing a modified chute feed and feed rollers at the "in" position adjacent to the conical roller.
Figure 2:
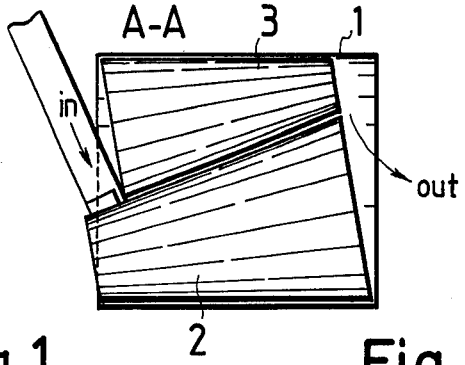
FIG. 2 is a side view taken along line A—A of FIG. 1.

Referring descriptively to the drawing, in FIGS. 1 and 2 is shown a device consisting of a cylinder 1 with working points in the inside and two conical rollers 2 and 3 each with points on the outside and all are at a suitable working distance. The roller 2 can be supposed to work like the cylinder, the roller 3 like the stripper roller and the cylinder 1 like the worker (and at the same time the doffer) of a roller card. The fibres are fed at "in" between 1 and 2. At every passage from 1 by 3 and 2 back to 1 the fibres are moving towards "out", which is the doffing area of 1. The conicity of rollers 2 and 3 and the dimensions of 1, 2 and 3 determine the average number of passages of the fibres between "in" and "out".

Figure 3:
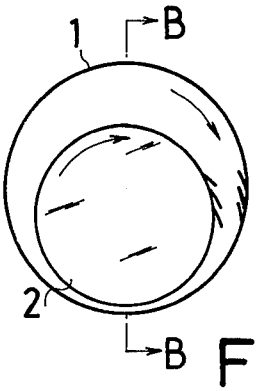
FIG. 3 is a modification of the invention of FIG. 1 having inside points and without a chute feed.
Figure 4:
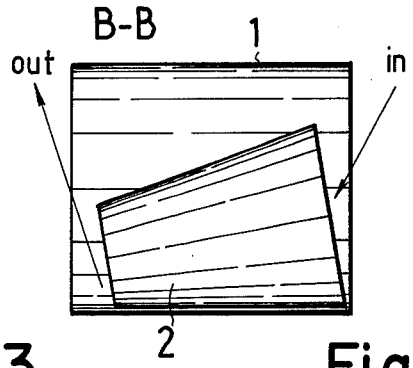
FIG. 4 is a side view taken along line B—B of FIG. 3.

In FIGS. 3 and 4 is shown a device consisting of a cylindrical roller 1 with inside points and a conical roller 2 with outside points at a working distance to 1. The fibres fed at "in" are worked and thrown out from 2 towards 1. Because of the direction of the planes of rotation the fibres are also moved towards "out" the doffing area of the roller 1.

Figure 5:
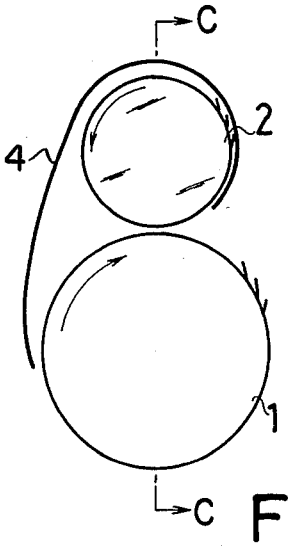
FIG. 5 is a modification of the invention of FIGS. 1 and 3 having outside points and without a chute feed.
Figure 6:
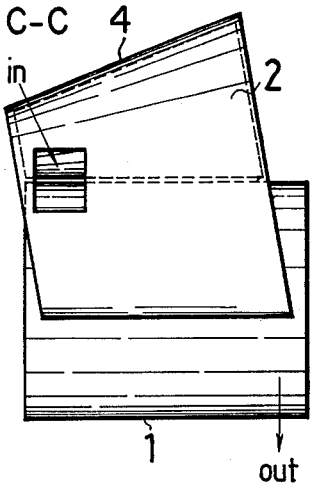
FIG. 6 is a side view taken along line C—C of FIG. 5.

In FIGS. 5 and 6 is shown a device consisting of a cylinder 1 with outside points and a conical roller 2 with outside points at a working distance to 1. A cover 4 surrounds the cone and a part of the cylinder. Fibres fed at "in" are worked and thrown from the cone 2 directly or via the cover 4 towards the cylinder 1. Because of the direction of the planes of rotation the fibres are also at every passage moved towards "out", the doffing area of the cylinder 1.

When using the device for carding (FIG. 1 and FIG. 2) a modified chute feed and feed roller at "in" adjacent to the conical roller 2 in FIG. 1 and FIG. 2 preferably should be used when the width of the fibre mat fed is at least 80–100 mm, which means that the inner diameter and length of the cylinder 1 in FIG. 1 and FIG. 2 are at least 500–600 mm. In this case also roller doffing is preferred, also wherein the doffing roller is placed at "out" adjacent to the cylinder 1 in FIG. 1 and FIG. 2. If the dimensions of the device are smaller, preopened fibre tufts are blown into the gap at "in" between the cylinder 1 and the conical roller 2 in FIG. 1 and FIG. 2, whereby a rationing of the fibre tufts blown has to be arranged. Doffing through a suctioning funnel at "out" adjacent to the cylinder 1 in FIG. 1 and FIG. 2 is then preferred. The fibres can be suctioned into an open end rotor or a cage system.

When using the device for cleaning or opening of fibre tufts as shown in FIGS. 1–6, preopened fibre tufts are blown into the gap at "in" between the cylinder 1 and the conical roller 2 in FIGS. 1–6. The cleaned or opened fibres are doffed through a suctioning funnel (not shown) at "out" adjacent to the cylinder 1 in FIGS. 1–6.

It is preferred to use only the device shown in FIGS. 1 and 2 for carding.

As various changes and modifications of the invention may be made it is intended that all matter herein shall be interpreted as illustrative and not in a limiting sense.

I claim:

1. In a device for carding, cleaning or opening of fibre tufts, said device comprising at least two operative members, the improvement comprising:

each of said at least two operative members having a plane of rotation, and said plane of rotation of one of said operative members intersecting the plane of rotation of the other of said operative members so that said planes intersect with each other;

said operative members permitting the fibres to be fed in at one end, to move in an axial direction and to pass through the lines of close proximity repeatedly in several changed planes of rotation, thereby to be worked by a high proportion of working points before being doffed at the other end.

2. In a device as claimed in claim 1, wherein said at least two operative members includes:

a worker/doffer; and first and second conical rollers, one of said conical rollers working like a cylinder and the other of said conical rollers working like a stripper of a roller card.

3. In the device as claimed in claim 2, wherein:

said first conical roller has its smaller base at the "in" feed and its larger base at the "out" feed, and said second conical roller has its larger base at the "in" feed and its smaller base at the "out" feed, and the fibres are fed between said first and said second rollers at the "in" feed and are moved thereby towards the "out" feed.

4. In the device as claimed in claim 2 or 3, including:

inside working points on the inside of said worker/doffer; and outside working points on the outside of each of said first and said second conical rollers.

5. In the device as claimed in claim 1, wherein said at least two operative members includes:

a cylindrical roller; and a conical roller at a working distance from said cylindrical roller.

6. In the device as claimed in claim 5, wherein said cylindrical roller includes inside points thereon, and said conical roller includes outside points thereon at the working distance from said inside points; and the fibres fed at an "in" feed are worked and thrown out from said conical roller towards said cylindrical roller to an "out" feed as a result of the direction of the planes of rotation so as to move the fibres towards said "out" feed which is a doffing area of said cylinder.

7. In the device as claimed in claim 1, wherein said at least two operative members includes:

a cylindrical roller having outside points thereon, and a conical roller having outside points thereon spaced at a working distance from said cylindrical roller.

8. In the device as claimed in claim 7, including:

a cover surrounding said conical roller and part of said cylindrical roller;

the fibres being fed at an "in" feed and worked and thrown from said conical roller towards said cylinder either directly or through the intermediation of said cover and are moved towards an "out" feed at a doffing area of said cylinder.

* * * * *